US009550655B2

(12) United States Patent
Senger et al.

(10) Patent No.: US 9,550,655 B2
(45) Date of Patent: Jan. 24, 2017

(54) PALLET RETURN IN MOVING WALKWAYS

(71) Applicants: Alois Senger, Gresten (AT); Alexander Turek, Vienna (AT)

(72) Inventors: Alois Senger, Gresten (AT); Alexander Turek, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/434,418

(22) PCT Filed: Nov. 1, 2012

(86) PCT No.: PCT/US2012/063046

§ 371 (c)(1),
(2) Date: Apr. 9, 2015

(87) PCT Pub. No.: WO2014/070185

PCT Pub. Date: May 8, 2014

(65) Prior Publication Data

US 2015/0274489 A1 Oct. 1, 2015

(51) Int. Cl.
*B66B 23/14* (2006.01)
*B66B 21/10* (2006.01)

(52) U.S. Cl.
CPC ..... *B66B 23/147* (2013.01); *B66B 21/10* (2013.01)

(58) Field of Classification Search
CPC ..... B66B 23/147; B66B 21/10
See application file for complete search history.

(56) References Cited

U.S. PATENT DOCUMENTS 5,727,669 A 3/1998 Rich, Jr.
6,234,295 B1 * 5/2001 Ogawa ..... B66B 23/12 198/333
6,640,957 B2 * 11/2003 Fargo ..... B66B 21/10 198/321
7,258,223 B2 * 8/2007 Strange ..... B65G 17/22 198/465.2
2003/0132087 A1 * 7/2003 Inoue ..... B66B 23/12 198/814

(Continued)

FOREIGN PATENT DOCUMENTS

CN 1454179 A 11/2003
CN 1874951 A 12/2006

(Continued)

OTHER PUBLICATIONS

International Preliminary Report on Patentability for application PCT/US2012/063046, May 30, 2013, 6 pages.

(Continued)

*Primary Examiner* — Thomas Randazzo
(74) *Attorney, Agent, or Firm* — Cantor Colburn LLP

(57) ABSTRACT

A moving walkway with a pallet return mechanism is disclosed. The moving walkway generally includes a pallet track having a passenger portion connected to a return portion through an end portion, a plurality of pallets coupled to the pallet track with each pallet extending between front and back ends, and a pallet return apparatus adapted to sequentially lower the front and back ends of the pallet to transition each pallet from the passenger portion to the return portion of the pallet track. Methods for returning the pallet on the pallet track are also disclosed.

20 Claims, 5 Drawing Sheets

(56) References Cited

U.S. PATENT DOCUMENTS

| | | | | |
|---|---|---|---|---|
| 2004/0035674 | A1* | 2/2004 | Inoue | B66B 23/12 198/321 |
| 2005/0247546 | A1* | 11/2005 | Strange | B65G 17/22 198/793 |
| 2006/0201778 | A1 | 9/2006 | Aulanko et al. | |
| 2008/0038104 | A1 | 2/2008 | Mustalahti et al. | |
| 2015/0284217 | A1* | 10/2015 | Park | B66B 21/10 198/321 |
| 2015/0307327 | A1* | 10/2015 | Srb-Gaffron | B66B 23/14 198/321 |

FOREIGN PATENT DOCUMENTS

| | | | | |
|---|---|---|---|---|
| CN | 101314451 | A | 12/2008 | |
| EP | 2138430 | A1 * | 12/2009 | B65G 17/18 |
| GB | 2299316 | A | 10/1996 | |
| JP | 2006-069787 | A | 3/2006 | |

OTHER PUBLICATIONS

Written Opinion for application PCT/US2012/063046, May 30, 2013, 6 pages.
Chinese Office Action and Search Report for application for CN 201280076800.0, dated Nov. 4, 2015, 7 pages.
International Search Report Application No. PCT/US2012/063046 reported on May 30, 2013.

* cited by examiner

PALLET RETURN IN MOVING WALKWAYS

CROSS-REFERENCE TO RELATED APPLICATION

This Application is a 35 USC §371 US National Stage filing of international Application No. PCT/US2012/063046 filed on Nov. 1, 2012.

TECHNICAL FIELD OF THE DISCLOSURE

The present disclosure is directed to moving walkways, and more particularly, to pallet type moving walkways.

BACKGROUND OF THE DISCLOSURE

Moving walkways are typically constructed in one of two basic styles, either pallet type or moving belt type. A moving belt type moving walkway typically includes a metal mesh or rubber belt disposed over a series of rollers. A pallet type moving walkway typically includes a continuous series of pallets joined together to form a walkway.

Pallet-type moving walkways generally include a truss assembly, which houses a drive mechanism that drives the pallets. Specifically, the pallets are fixed to a drive chain that includes a plurality of interconnected rollers. The drive chain is engaged with a chain track and is operatively connected to the drive mechanism, such as one or more drive sprockets. As the drive mechanism drives the drive chain, the pallets moves along the chain track from a passenger carrying side to a return side, which is typically located below the passenger carrying side. The walkway assembly including the truss assembly, drive mechanism and the return side of the walkway is typically located in a pit constructed for that purpose.

In moving walkways with pit construction, the height difference between the surrounding floor level and the passenger carrying portion of the pallets (i.e. pallet height) may sometimes require relatively steep and/or lengthy ramps at the ends of the moving walkway for passenger comfort and handicapped access. In addition, parallel moving walkways, operating in opposite directions, would require two pits, two drive mechanisms and two pallet bands, thereby further adding expense and space requirements for installation of the moving walkways.

Thus, there is a need for a moving walkway that may not need a pit in the floor and therefore may be mounted either on finished, existing floors or in foreseen openings of the floating screed but doesn't have any impact on the structure of floors (concrete ceilings, beams, etc.). Moreover, there is a need for a pallet return mechanism that accommodates the aforementioned pit-free moving walkway. Finally, there is a need for pit-free moving walkways with pallet return mechanisms that do not adversely affect the functionality, simplicity, and reliability of the moving walkways.

SUMMARY OF THE DISCLOSURE

According to one aspect of the present application, a moving walkway is disclosed as generally including a pallet track having a passenger portion connected to a return portion through an end portion, a plurality of pallets coupled to the pallet track with each pallet extending between front and back ends, and a pallet return apparatus adapted to sequentially lower the front and back ends of the pallet to transition each pallet from the passenger portion to the return portion of the pallet track.

According to another aspect of the present application, a method for returning a pallet on a pallet track of a moving walkway, wherein the pallet track includes a passenger portion connected to a return portion through an end portion, is disclosed. The method may include the steps of allowing the pallet to move on the passenger portion of the pallet track, sequentially lowering front and back ends of the pallet from the passenger portion to the return portion of the pallet track, and allowing the pallet to move on the return portion of the pallet track.

According to yet another aspect of the present application, a moving walkway is disclosed. The moving walkway may include a plurality of pallets coupled to and guided by a pallet track, each of the plurality of pallets having at least one front roller and at least one rear roller for guiding each of the plurality of pallets in the pallet track. The moving walkway may also include a pallet return apparatus having a return guide for facilitating a turnaround of each of the plurality of pallets from a passenger side to a return side and a leg movably connected to each of the plurality of pallets, each of the legs guiding the engagement of the at least one rear roller into the return guide while the at least one front roller continues along the pallet track.

The moving walkway may include one or more of the following features, either alone or in combination:

- a pallet return apparatus that lowers the back end of each of the plurality of pallets while the front end remains on the passenger portion of the pallet track and moves toward the end portion of the pallet track;
- a pallet return apparatus that comprises a pallet guide positioned between the passenger portion and the return portion of the pallet track, the back end of each of the plurality of pallets adapted to be selectively lowered into the pallet guide by the pallet return apparatus.
- a pallet guide that guides the motion of the back end of each of the plurality of pallets while the front end of each of the plurality of pallets moves along the end portion of the pallet track;
- adapting the back end of each of the plurality of pallets to be lowered from the pallet guide to the return portion of the pallet track after the front end of the pallet enters the return portion of the pallet track;
- a pivotable leg movably connecting each of the pallets to the drive chain;
- a pivotable leg that pivots about a point on the pallet;
- a pivotable leg that pivots about a point on the chain;
- connecting each link to at least one roller disposed in the chain track;
- a chain track with a bottle-neck shape for facilitating engagement of the back end of the pallet with the pallet guide; and/or
- coupling each of the plurality of pallets to the pallet track through one or more rollers disposed in the pallet track.

Other advantages and features of the disclosed apparatus and method will be described in greater detail below. It will also be noted here and elsewhere that the apparatus or method disclosed herein may be suitably modified to be used in a wide variety of applications by one of ordinary skill in the art without undue experimentation.

BRIEF DESCRIPTION OF THE DRAWINGS

For a more complete understanding of the disclosed apparatus and method, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed device or method which render other details difficult to perceive may have been omitted. It should be understood, of course, that this disclosure is not limited to the particular embodiments illustrated herein.

DETAILED DESCRIPTION OF THE DISCLOSURE

Figure 1:
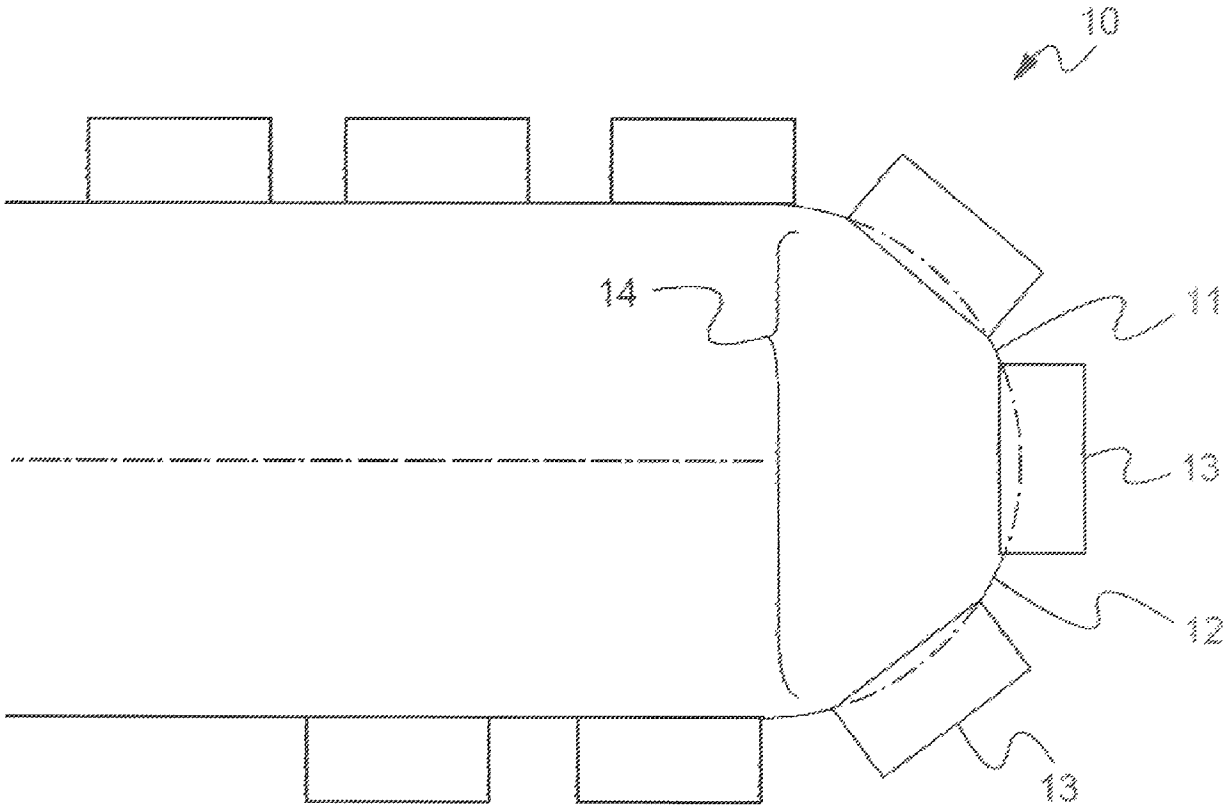
Fig. 1 (Prior Art)
FIG. 1 schematically illustrates one prior art moving walkway with a classical pallet turning design.

Referring now to FIG. 1, a schematic representation of a conventional moving walkway 10 (classical design) illustrating pallet motion therein is shown. As shown, the moving walkway 10 may include a drive chain 11 movably disposed within a chain (or pallet) track 12. The moving walkway 10 further includes a plurality of pallets 13 fixedly connected to the drive chain 11. In use, the drive chain 11 is operated by a drive mechanism (not shown), such as a drive sprocket, to move within the chain track 12. As the pallets 13 are fixedly connected to the drive chain 11 and therefore have zero degree of freedom relative to the drive chain 11, the pallets follow the chain track 12 and turn up-side-down at an end portion 14 of the moving walkway 10. One feature of the classical design is that the pallets 13 move at the same speed as the driven chain 11 at any portion of the moving walkway 10.

Figure 2:
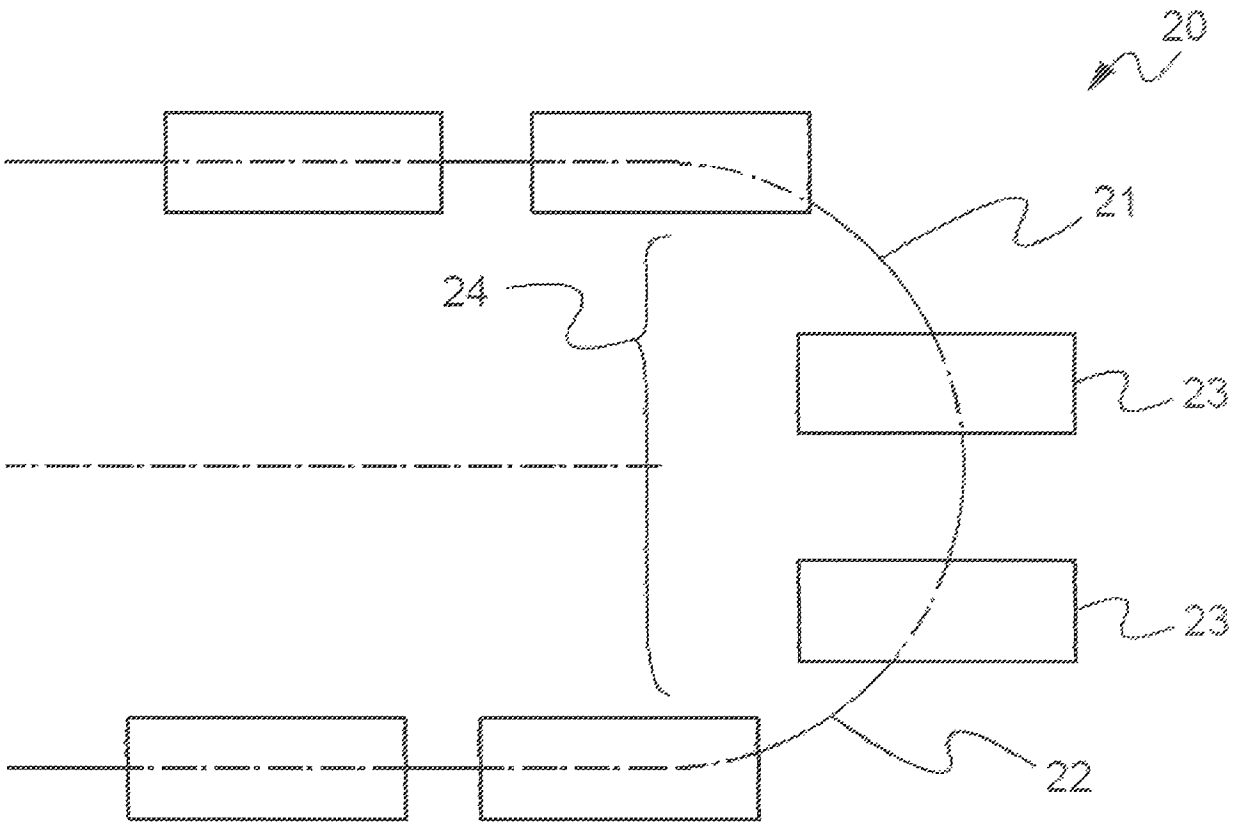
Fig. 2 (Prior Art)
FIG. 2 schematically illustrates another prior art moving walkway with a Paternoster pallet turning design.

Turning to FIG. 2, another conventional moving walkway 20 (Paternoster design) showing pallet motion therein is illustrated as generally including a drive chain 21 movably disposed within a chain (or pallet) track 22. The moving walkway 20 further includes a plurality of pallets 23 directly hinged to drive chain 21. In use, the drive chain 21 is operated by a drive mechanism (not shown) to move within the chain track 22. As the pallets 23 are directly hinged to the drive chain 21 with one degree of freedom, the pallets 23 follow the chain track 22 but rotate relative to the drive chain to maintain its horizontal orientation at an end portion 24 of the moving walkway 20. Similar to the classical design, a feature of the Paternoster design is that the pallets 23 move at the same speed as the driven chain 21 at any portion of the moving walkway 20.

Figure 3:
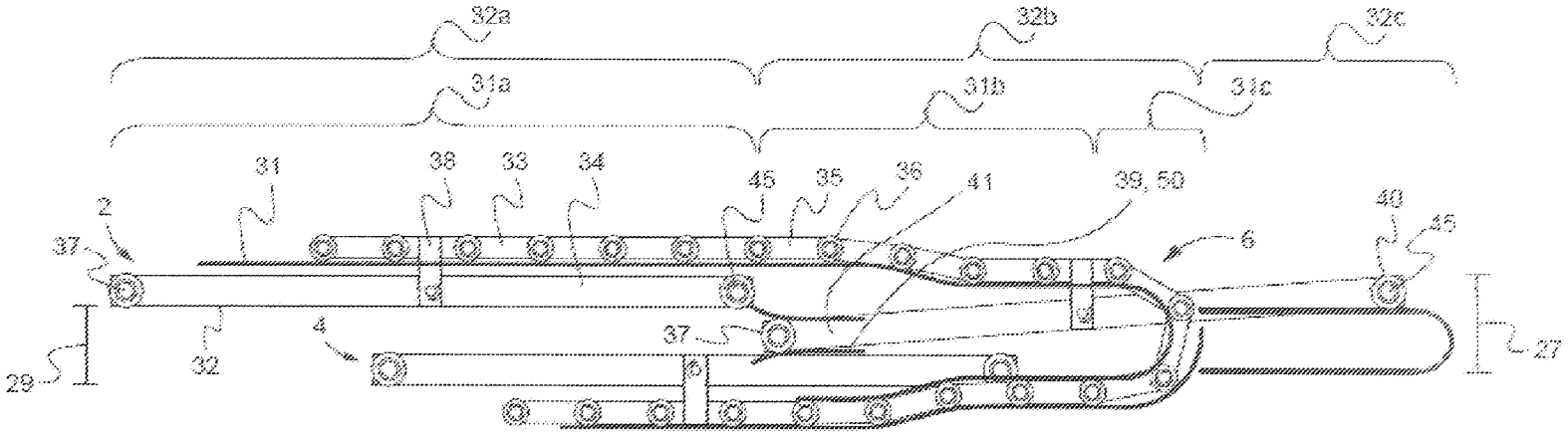
FIG. 3 is a schematic side view of one embodiment of a moving walkway according to the present disclosure.

Referring now to FIG. 3, a first embodiment of a moving walkway 30 is shown, in accordance with at least some embodiments of the present disclosure. As shown, the moving walkway 30 may include a chain track 31 and a drive chain 33 movably disposed in the chain track. The drive chain 33 may include a plurality of interconnected links 35, at least some of which may be provided with rollers 36 disposed in the chain track 31 to facilitate movement of the drive chain along the chain track. The moving walkway 30 may additionally include a pallet track 32 having a plurality of pallets 34. Each of the plurality of pallets 34 may be provided with front and rear rollers 45 and 37, respectively, disposed in the pallet track 32 so that the pallets may be coupled to and be guided by the pallet track. The pallet track 32 may also extend longitudinally further than the chain track 31.

In addition, each of the plurality of pallets 34 may be movably (e.g., pivotably) connected to the drive chain 33. Specifically, at least some of the interconnected links 35 (e.g., links 35*a*, 35*b*) of the drive chain 33 may include legs (e.g., levers) 38 configured to be pivotably connected to the pallets 34 and/or the drive chain 33 such that the pallets can have at least one degree of freedom (i.e. rotation) relative to the drive chain. FIG. 3 shows one mechanism of pivotably connecting the drive chain 33 and the pallets 34 by way of the legs 38. More specifically, the legs 38 between the links 35 (e.g., the links 35*a*, 35*b*) of the drive chain 33 and the pallets 34 may be fixed to the links (e.g., to a link plate) of the drive chain and pivot at the pallet joint, thereby resulting in a very short distance between the pallets 34 on passenger and the return sides 2 and 4, respectively, and allowing to reduce a pallet height 27 (distance between the floor and the pallet track on the passenger side 2) of the pallet track 32. Another pivotable connection between the drive chain 33 and the pallets 34 is described below with respect to FIG. 4.

Furthermore, unlike the classical and Paternoster designs of FIGS. 1 and 2, respectively, the pallet track 32 and the chain track 31 of the moving walkway 30 may be offset from one another in the area of the return mechanism. In at least some embodiments and, as shown in FIG. 3, the chain track 31 and the pallet track 32 may be vertically offset from each other, on both the passenger side 2 (e.g., the side on which the passengers ride) and the return side 4. In other words, as viewed from the side, the pallet track 32 may lie within the chain track 31 with the passenger side 2 of the pallet track above the return side 4 of the pallet track (i.e., the pallets on the return side of the pallet track 32 can be positioned vertically higher than the chain track 31 on the return side) to reduce a pallet gap (PG) 29 between the pallets 34 on the passenger side and the return side.

By positioning the pallet track 32 within the chain track 31, the pallets 34 may travel at a slower speed than the drive chain 33 at a turnaround portion 6 of the pallet and the chain tracks 32 and 31, respectively, resulting in a relatively narrow pallet track return at the turnaround portion.

Figure 4:
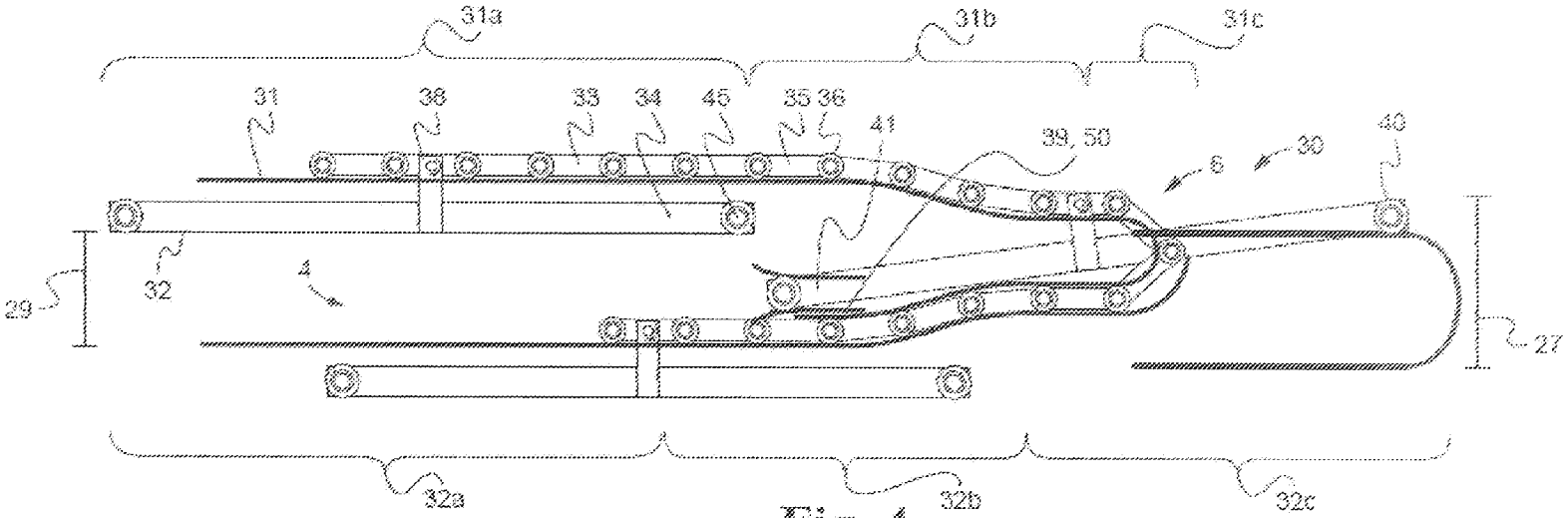
FIG. 4 is a schematic side view of another embodiment of a moving walkway according to the present disclosure.
Figure 5:
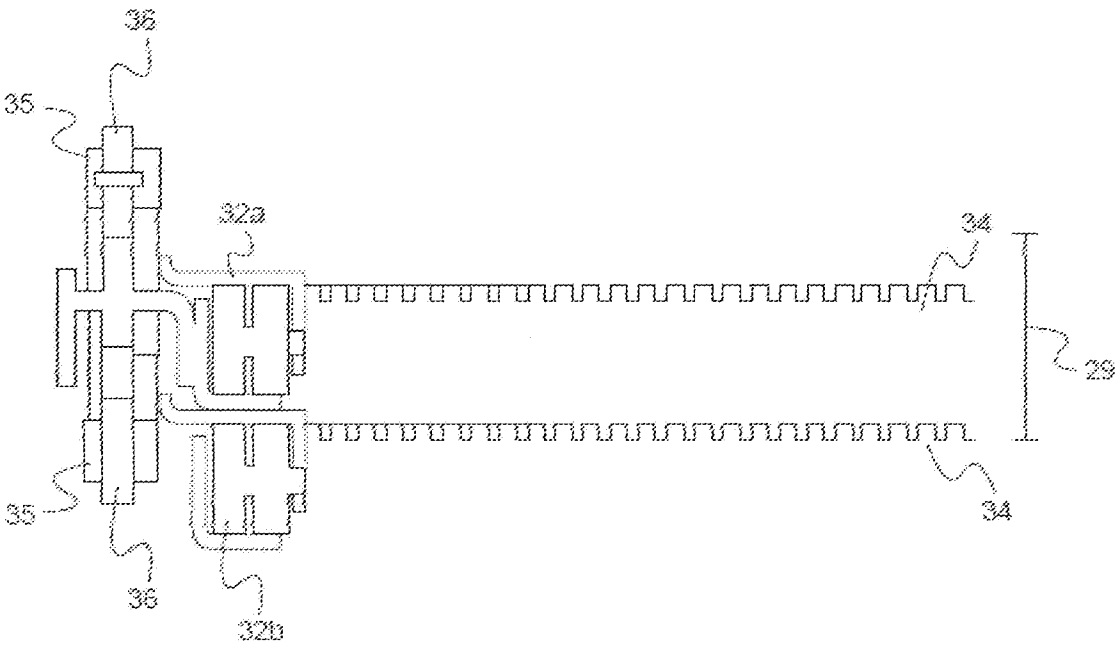
FIG. 5 is partial front view of the moving walkway illustrated in FIG. 4.

Referring now to FIGS. 4-5, a second embodiment of the moving walkway 30 is shown, in accordance with at least some embodiments of the present disclosure. To the extent that the moving walkway 30 of FIG. 3 is substantially similar to the moving walkway of FIG. 3, only the differences between the two have been described. Similar to the moving walkway 30 of FIG. 3, the moving walkway of FIG. 4 may include the chain track 31 and the pallet track 32 separated from the pallet track. However, in contrast to the embodiment of FIG. 3 in which the chain track and the pallet track 31 and 32, respectively, are vertically offset from one another, in FIG. 4, the chain track and the pallet track are both horizontally and vertically offset from one another. In other words, the chain track 31 may be vertically above and horizontally outside of the pallet track 32 and thus disposed within the balustrade, thereby providing some pallet height savings. In embodiments that reduced pallet gap 29 is not necessary or even not desirable, the pallets 34 on the return side 4 of the pallet track 32 can be positioned vertically lower than the chain track 31 on the return side, as illustrated in FIGS. 4-5.

In further contrast to FIG. 3, the pivotable connection between the drive chain 33 and the pallets 34 in FIG. 4 is such that the legs 38 between the interconnected links 35 (e.g., the links 35*a*, 35*b*) of the drive chain 33 and the pallets 34 may be fixed to the pallets and may pivot at the drive chain link plate, thereby resulting in a somewhat bigger distance (compared to the pivotable connection of FIG. 3) between the pallets on the passenger and the return sides 2 and 4, respectively.

It will be understood that although FIG. 3, which describes a vertical separation between the chain track 31 and the pallet track 32, has been described with one type of a pivotal linkage between the drive chain 33 and the pallets 34 and, FIG. 4 which describes both a horizontal and vertical separation between the chain and the pallet tracks, has been described with a different pivotal linkage, the type of pivotal linkage between the drive chain and the pallets in independent of the type of separation between the chain track and the pallet track. Thus, depending upon the space and other requirements for the moving walkway, the pivotal linkage of FIG. 3 may be employed with the configuration of FIG. 4 and relatedly, the pivotal linkage described in FIG. 4 may be employed with the configuration of FIG. 3. Further, although illustrated as having separated guide tracks for the pallets and chains throughout the moving walkway, it should be understood that the pallet return mechanism would also be effective with embodiments having shared pallet and chain tracks within the passenger and return portions of the moving walkway, i.e., no vertical and/or horizontal separation in those portions of the walkway.

Additionally, the pivotable connections described above are merely two embodiments of the movable connections between the drive chain 33 and the pallets 34. Other coupling mechanisms that enable one or more degree of freedom between the drive chain 33 and the pallets 34 may also be employed. For example, the pallets 34 may be coupled to the drive chain 33 through a geared connector so that the pallets can have rotational and/or translational movement relative to the drive chain.

Thus, the movable connection between the drive chain 33 and the pallets 34 allows both, travel at different speeds at their corresponding end portions (described below) and through different paths, thereby allowing pallet return designs that reduce the pallet height (PH) 27 compared to traditional moving walkways 10 and 20 of FIGS. 1 and 2, respectively. The chain track 31 may also be conveniently disposed within the balustrade by virtue of separating the chain track from the pallet track 32.

Turning back to FIGS. 3-5, a turn-around mechanism for turning the pallets 34 from the passenger side 2 to the return side 4 will now be described. As shown, to facilitate turnaround, the chain track 31 may be composed of multiple track portions. For example, on the passenger side 2, the chain track 31 may include a passenger portion 31*a* connected to a lowered chain track portion 31*b*, which in turn may be connected to an end (or turn) chain track portion 31*c*. The chain track portions (31*a-c*) may sequentially have the same arrangement (e.g., the passenger portion 31*a* connected to the end chain track portion 31*c* through the lowered chain track portion 31*b*) on the return side 4, such that the chain track on the passenger side 2 is at least substantially parallel to the chain track on the return side. Furthermore, the passenger portion 31*a* may, but not necessarily, be substantially parallel to the lowered chain track portion 31*b*. Additionally, the chain track 31 may be designed to have a 'bottle neck' shape at the lowered chain track portion 31*b* and the end chain track portion 31*c* of the chain track. The "bottle-neck" shape of the chain track 31 may facilitate turnaround of the pallets 34 without colliding into one another.

Relatedly, the pallet track 32 may include a passenger portion 32*a*, a pallet back roller track/guide portion (or return portion) 32*b* and a pallet front roller track/guide portion (or end portion) 32*c*. Moreover, the passenger portion 31*a* of the chain track 31 may be at least substantially parallel to the passenger portion 32*a* of the pallet track 32. Similarly, the lowered chain track portion 31*b* of the chain track 31 may be at least substantially parallel to the return portion 32*b* of the pallet track 32. As a result, the drive chain 33 and the pallets 34 may be travelling at the same speed at the passenger and return or lowered chain track portions of their corresponding tracks. However, in the embodiments of FIGS. 3 and 4, the end chain track portion 31*c* of the chain track 31 may not be parallel to the end portion 32*c* of the pallet track 32 so as to allow pallet return designs that reduce the pallet height 27, as discussed later in the present disclosure.

Without wishing to be bound by any particular theory, it is contemplated that the shape, orientation, and relative dimensions of the end portions (31*c*, 32*c*) of the drive and pallet tracks (31, 32), respectively, in combination with the movable connection between the drive chain 33 and pallets 34, allows the drive chain 33 and the pallets 34 to travel at different speed at the corresponding end portions (31*c*, 32*c*) of the drive and the pallet tracks (31, 32), thereby reducing the pallet height 27 of the turn-around portion of the moving walkway 30 as compared to conventional moving walkways (10, 20), an insight heretofore unknown. In addition to the various track portions of the chain track 31 and the pallet track 32 described above, to facilitate turnaround, the front rollers 45 and the rear rollers 37 of the pallets 34 may be designed to follow the same path in the passenger portion 32*a* and the pallet back roller track/guide portion 32*b* of the pallet track, while the rear rollers may be guided in a different path as the front rollers are guided through the end portion 32*c*.

To guide the rear rollers 37 in the different path as the front rollers 45 complete the turnaround from the passenger side 2 to the return side 4, the legs 38 connecting the drive chain 33 to the pallets 34 may be connected in a substantially central portion of the pallets. By virtue of connecting the legs 38 in the substantially central portion of the pallets 34, the rear rollers 37 may be disengaged from the pallet track and guided in a pallet return mechanism as the front rollers 45 continue along the pallet track to transition the pallets from the passenger side 2 to the return side 4 at the turnaround. Additionally, by connecting the legs 38 in a substantially central location of each of the pallets 34, the legs provide support to the pallets, thereby reducing the thickness of each pallet and consequently reducing a pallet height (PH) 27 of the moving walkway 30.

Referring still to FIGS. 3-5, one embodiment of the pallet return mechanism according to the present disclosure is disclosed. Specifically, the moving walkway 30 may include a pallet return apparatus 50 to transition front and back ends 40 and 41, respectively, of the pallets 34 from the passenger portion 32*a* to the return portion 32*b* of the pallet track 32. The pallet return apparatus 50 may include a return guide 39 positioned between the passenger portion 32*a* and return portion 32*b* of the pallet track 32, as illustrated in FIGS. 3-4. The term "front" used in the present disclosure refers to the direction in which the pallet 34 moves in the passenger portion and the term "back" used in the present disclosure refers to the direction against which the pallet 34 moves in the passenger portion.

In operation, the front end 40 (and the front roller 37) of the pallet 34 may follow the passenger portion 32*a* into the end portion 32*c* (through the return portion 32*b*) on the passenger side 2 of the pallet track 32, where the front end of the pallet may turn around and head towards the return portion 32*b* of the pallet track 32 on the return side 4. The return guide 39 is positioned along the pallet track 32 between the passenger portion 32*a* and return portion 32*b* so that the back end 41 (and the back roller 37) of the pallets 34 can be lowered into the return guide 39 on the passenger side 2 while the front end 40 (and the front roller 37) of the pallets maintains its direction toward the end portion 32*c* of the pallet track.

As the front end 40 of the pallet 34 turns around at the end portion 32*c* of the pallet track 32 to arrive on the return side 4, the back end 41 of the pallet 34 stays and reverses its direction of movement within the return guide 39. After completion of the turnaround, the front end 40 of the pallet 34 enters into the return portion 32*b* of the pallet track 32 on the return side 4, while the back end 41 of the pallet 34 remains within the return guide 39 and above the front end 40. As the front end 40 of the pallet 34 moves further along the return portion 32*b* of the pallet track 32 on the return side 4, the back end 41 of the pallet 34 moves out of the return guide 39 and is lowered to the return portion 32*b* into the return side 4 of the pallet track 32, thereby completing the turnaround of the pallet 34.

The transition of the pallets 34 from the passenger portion 32*a* to the return portion 32*b* is performed by the "bottle-neck" shape or the lowered chain track portion 31*b* of the chain track 31 and the legs 38 guiding the front rollers 45 and the rear rollers 37 of the pallets 34. Specifically, as mentioned above, the legs 38 are connected in a substantially central portion of each of the pallets 34 with the front rollers 45 being in front of the legs and the rear rollers being at the back or behind the legs. As the drive chain 33 moves along the chain track 31 on the passenger side 2, the legs 38 guide the pallets 34 within the pallet track 32 (by way of the rollers 37 and 45). By lowering the chain track 31 (in the lowered chain track portion 31*b*) before the turnaround 6 of the chain track (in the end portion 31*c*), the leg 38 entering the bottle-neck shape causes the pallet 34 and, particularly, the rear roller 37 of the pallet, connected to that leg to be lowered and engaged within the return guide 39. Since the pallet track 32 extends beyond the chain track 31, before the leg 38 enters the lowered chain track portion 31*b* of the chain track, the front roller 45 of the pallet 34 connected to that leg continues to be guided straight in the pallet track 32 without being lowered into the return guide 39. It is the entering of the leg 38 in the lowered chain track portion 31*b* on the passenger side 2 that causes the leg to be lowered and therefore the rear roller 37 of the associated pallet 34 to be lowered and engaged within the return guide 39 of the pallet return mechanism 50. This engagement of the rear roller 37 with the return guide 39 happens before the turnaround of the drive chain 33 and the turnaround of the pallet 34.

The rear roller 37 remains engaged in the return guide 39 while the front roller 45 of the pallet 34 and the drive chain 33 turn around. As the leg 38 exits the lowered chain track portion 31*b* on the return side 4 of the chain track 31, the front roller 37 of the pallet 34 completes the turn around and the rear roller 37 disengages from the return guide 39 and enters the return portion 32*b* of the pallet track 32, thereby completing the turnaround from the passenger side 2 to the return side 4. Thus, while the legs 38 are engaged within the lowered chain track portion 31*b* of the chain track 31, the rear rollers 37 of the pallets 34 are engaged within the return guide 39 while the front rollers 45 of the associated pallets complete the turn around on the pallet track 32.

Unlike the Paternoster design in FIG. 2, the pallet turnaround design disclosed herein allows sequential (instead of simultaneous) lowering of the front and back ends 40 and 41, respectively, of the pallets 34 from the passenger side 2 to the return side 4 of the pallet track 32. Further, unlike the classical design in FIG. 1, the pallet turnaround designs disclosed herein does not involve any up-side-down reversion of the pallets 34.

Without wishing to be bound by any particular theory, it is contemplated that the pallet return design disclosed herein may have one or more desirable features that are unavailable to existing pallet turnaround designs. Those features include, but are not limited to, compatibility with existing track design and construction (without any significant modification or additional mechanism), minimizing impact collisions between the pallets in the turnaround, keeping the chain track 31 relatively simple and suitable for a conventional drive system (sprocket), and minimizing the number of joints in the linkage system (between the drive chain and the pallets) for easier maintenance.

It is to be understood that the track separation of the chain track 31 and the pallet track 32, and the turnaround mechanisms discussed above may be employed independently from one another. Thus, in at least some embodiments, the track separation may be employed without the pallet return mechanism, while in some other embodiments, the pallet return mechanism may be employed with the classical walkway designs (e.g., the walkways of FIGS. 1 and 2) that do not have track separation.

INDUSTRIAL APPLICABILITY

Figure 6:
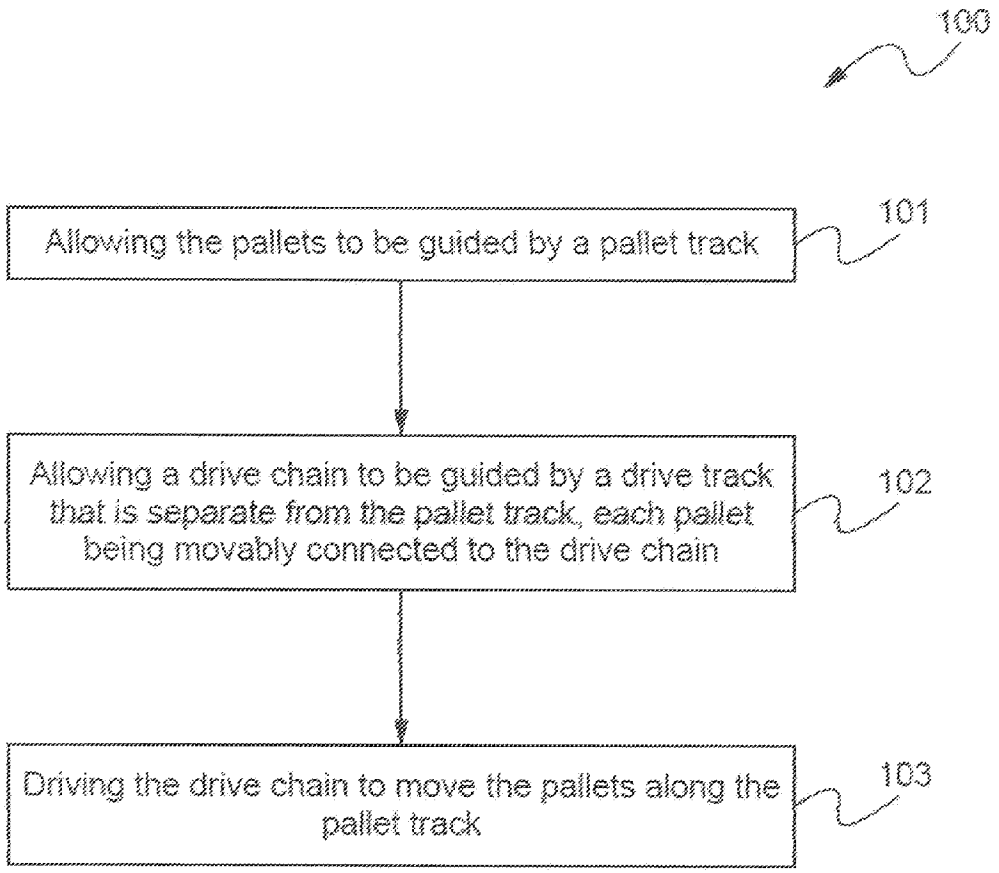
FIG. 6 is a block diagram of a method for sequentially lowering/lifting front and back ends of pallets with reducing distance between a passenger portion and a return portion of an endless series of pallets according to one aspect of the present disclosure.

The separation of chain and the pallet tracks disclosed herein may have a wide range of applications in design, installation and operation of moving walkways. As illustrated in FIG. 6, a method for reducing a distance between passenger portion and return portion of an endless series of pallets is generally referred to as reference numeral 100. The method 100 may generally include the steps of allowing the pallets to by guided by a pallet track 101, allowing a drive chain to be guided by a chain track that is separate from the pallet track and to which each pallet is movably connected 102, and driving the drive chain to move the pallets along the pallet track.

By virtue of sequentially lowering pallets in the turnaround portion, the depth of the pallet return mechanism may be reduced and thereby the depth of the moving walkway. Furthermore, the pivotable connection between the chain track and the pallet track may provide a smooth movement and acceleration in a relatively simple turnaround, while reducing the pallet height of the entire pallet band.

While only certain embodiments have been set forth, alternative embodiments and various modifications will be apparent from the above descriptions to those skilled in the art. These and other alternatives are considered equivalents and within the spirit and scope of this disclosure.

The invention claimed is:

1. A moving walkway, comprising:

a pallet track including a passenger portion connected to a return portion through an end portion;

a plurality of pallets coupled to the pallet track, each of the plurality of pallets extending between a front end and a back end; and a pallet return apparatus adapted to sequentially lower the front and back ends of each of the plurality of pallets to transition each pallet from the passenger portion to the return portion of the pallet track.

2. The moving walkway of claim 1, wherein the pallet return apparatus lowers the back end of each of the plurality of pallets while the front end remains on the passenger portion of the pallet track and moves toward the end portion of the pallet track.

3. The moving walkway of claim 2, wherein the pallet return apparatus comprises a pallet guide positioned between the passenger portion and the return portion of the pallet track, the back end of each of the plurality of pallets adapted to be selectively lowered into the pallet guide by the pallet return apparatus.

4. The moving walkway of claim 3, wherein the motion of the back end of each of the plurality of pallets is guided by the pallet guide while the front end of each of the plurality of pallets moves along the end portion of the pallet track.

5. The moving walkway of claim 4, wherein the back end of each of the plurality of pallets is adapted to be lowered from the pallet guide to the return portion of the pallet track after the front end of the pallet enters the return portion of the pallet track.

6. The moving walkway of claim 1, wherein each of the plurality of pallets is movably connected to a drive chain through a pivotable leg.

7. The moving walkway of claim 6, wherein the leg pivots about a point on the pallet.

8. The moving walkway of claim 6, wherein the leg pivots about a point on the chain.

9. The moving walkway of claim 6, wherein the drive chain includes a plurality of interconnected links, each link is connected to at least one roller disposed in a chain track.

10. The moving walkway of claim 9, wherein a portion of the chain track has a bottle-neck shape for facilitating engagement of the back end of each of the plurality of pallets with the pallet guide.

11. The moving walkway of claim 1, wherein each of the plurality of pallets is coupled to the pallet track through one or more rollers disposed in the pallet track.

12. A method for returning a pallet on a pallet track of a moving walkway, the pallet track including a passenger portion connected to a return portion through an end portion, the method comprising:

allowing the pallet to move on the passenger portion of the pallet track;

sequentially lowering front and back ends of the pallet from the passenger portion to the return portion of the pallet track; and allowing the pallet to move on the return portion of the pallet track.

13. The method of claim 12, wherein the back end of the pallet is lowered while the front end of the pallet remains on the pallet track and moves toward the end portion of the pallet track.

14. The method of claim 13, wherein the back end of the pallet is lowered into a pallet guide positioned between the passenger and return portions of the pallet track.

15. A moving walkway, comprising:

a plurality of pallets coupled to and guided by a pallet track, each of the plurality of pallets having at least one front roller and at least one rear roller for guiding each of the plurality of pallets in the pallet track;

a pallet return apparatus having a return guide for facilitating a turnaround of each of the plurality of pallets from a passenger side to a return side; and a leg movably connected to each of the plurality of pallets, each of the legs guiding the at least one rear roller into engagement with the return guide while the at least one front roller continues along the pallet track.

16. The moving walkway of claim 15, further comprising a drive chain disposed in and guided by a chain track, wherein engagement of the at least one rear roller with the return guide happens before the turnaround of the drive chain.

17. The moving walkway of claim 16, wherein the engagement occurs when the leg enters a lowered chain track portion of the chain track on the passenger side.

18. The moving walkway of claim 15, wherein the at least one rear roller remains engaged to the return guide until the at least one front roller completes the turnaround and enters a return portion of the pallet track.

19. The moving walkway of claim 15, wherein the leg is pivotably connected to a substantially central portion of each of the plurality of pallets for facilitating the turnaround.

20. The moving walkway of claim 15, wherein the leg pivots about a point on the pallet or about a point on a drive chain.

* * * * *